US005413041A

United States Patent [19]

De Concini et al.

[11] Patent Number: 5,413,041

[45] Date of Patent: May 9, 1995

[54] HIGH-SPEED WEB-FED FLEXOGRAPHIC PRINTER

[75] Inventors: Luigino De Concini; Domenico Fasoli, both of Cles; Sergio Pimazzoni; Gabriele Rullini, both of Verona, all of Italy

[73] Assignee: Arnoldo Mondadori Editore S.p.A., Italy

[21] Appl. No.: 175,147

[22] Filed: Dec. 29, 1993

[30] Foreign Application Priority Data

May 7, 1993 [IT] Italy ..... TO93A0320

[51] Int. Cl.[6] ..... B41F 1/46

[52] U.S. Cl. ..... 101/348; 101/228; 101/349; 101/350

[58] Field of Search ..... 101/348, 349, 350, 352, 101/363, 364, 247, 248, 179, 180, 181, 226, 219, 228

[56] References Cited

U.S. PATENT DOCUMENTS

| | | | |
|---|---|---|---|
| 3,518,940 | 7/1970 | Stroud et al. | 101/223 |
| 3,559,572 | 2/1971 | Hackley | 101/350 |
| 3,613,598 | 10/1971 | Heurich | 101/350 |
| 3,889,596 | 6/1975 | Thomas et al. | 101/352 |
| 4,362,179 | 12/1982 | MacPhee et al. | 101/364 |
| 4,407,196 | 10/1983 | Matalia | 101/229 |
| 4,428,288 | 1/1984 | Harper et al. | 61/248 |
| 4,474,110 | 10/1984 | Rosner | 101/217 |
| 4,782,753 | 11/1988 | Bolza-Schunemann | 101/363 |
| 4,912,824 | 4/1990 | Baran | 101/348 |
| 5,003,873 | 4/1991 | Lauber | 101/219 |
| 5,031,532 | 7/1991 | Walther | 101/248 |
| 5,127,325 | 7/1992 | Fadner | 101/348 |
| 5,239,924 | 8/1993 | Wallmann et al. | 101/179 |
| 5,264,481 | 11/1993 | Hutter et al. | 106/30 R |

FOREIGN PATENT DOCUMENTS

| | | |
|---|---|---|
| 0290850 | 11/1988 | European Pat. Off. . |
| 0308367 | 3/1989 | European Pat. Off. . |
| 448987 | 9/1927 | Germany . |

OTHER PUBLICATIONS

Patent Abstracts of Japan, vol. 10, No. 301 (M-525) (2357) 14 Oct. 1986 including JP-A-61 114 852 (Mitsubishi Heavy Ind Ltd) 2 Jun. 1986 (1 page).

Deutscher Drucker, No. 52, 14 Dec. 1989, p. 27, XP000095179, "Konsequente Forschung steigert die Transparenz: Herzstück Rasterwalze im Optimierungsprozess"(1 page).

*Primary Examiner*—Eugene H. Eickholt

*Attorney, Agent, or Firm*—Webb Ziesenheim Bruening Logsdon Orkin & Hanson

[57] ABSTRACT

A printer comprising a printing roller supporting a matrix strip; a pressure roller for pressing the web on to the matrix at a first portion of the printing roller; and an inking unit including an inking roller contacting the matrix at a second portion of the printing roller; the cylindrical outer surface of the inking roller presenting microincisions, and being partially immersed in water-based ink inside a tank; and surplus ink being removed from the surface of the inking roller by a doctor blade prior to transfer on to the matrix.

9 Claims, 4 Drawing Sheets

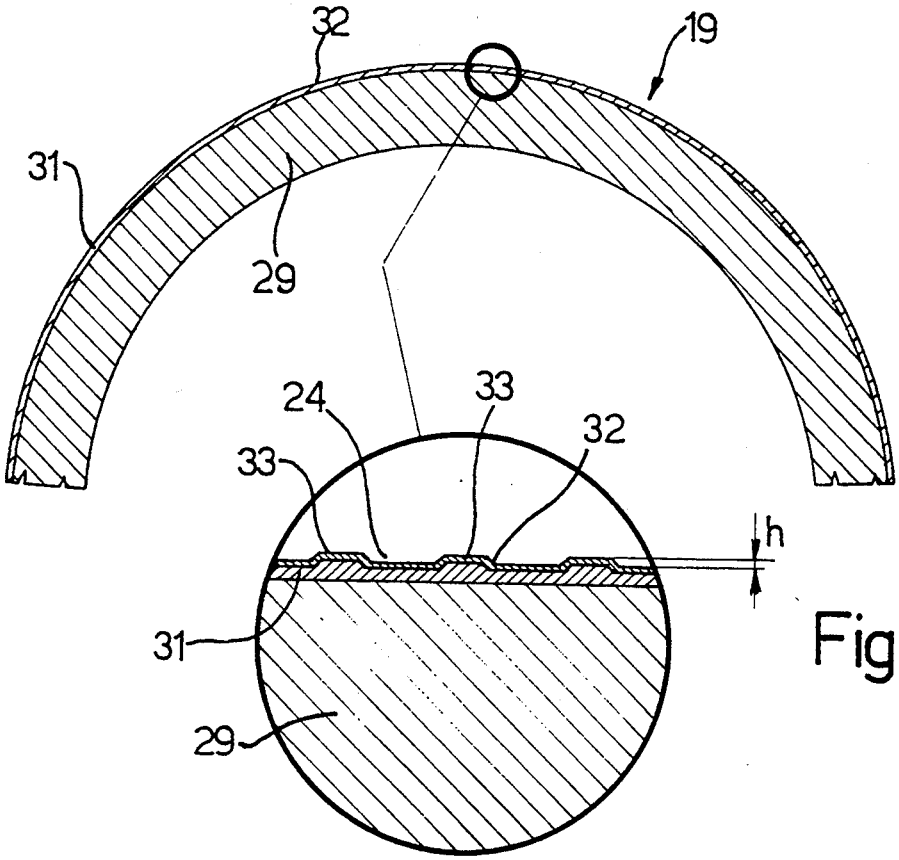
Fig.3
Fig. 4
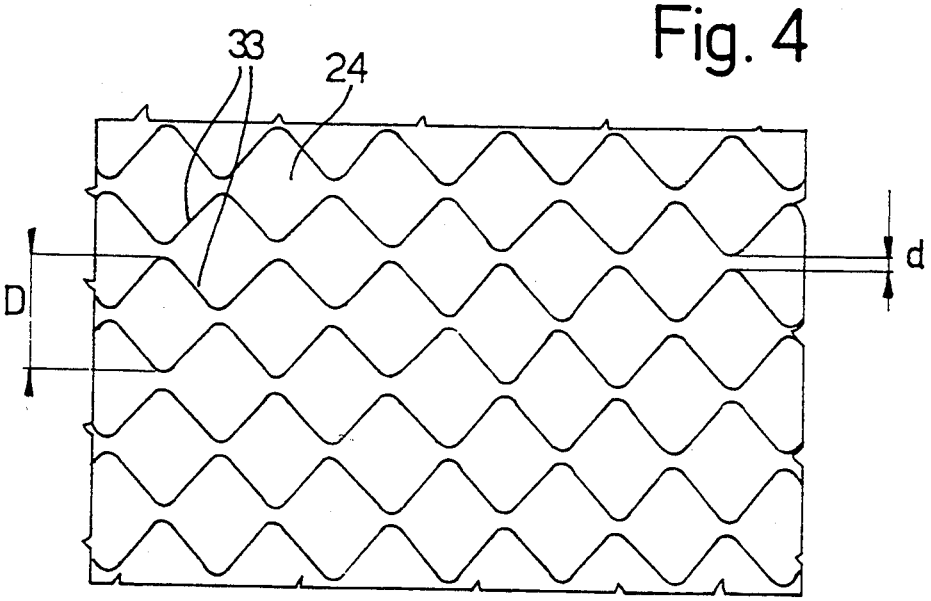

HIGH-SPEED WEB-FED FLEXOGRAPHIC PRINTER

BACKGROUND OF THE INVENTION

The present invention relates to a high-speed web-fed flexographic printer, in particular, comprising at least one printing roller supporting a matrix strip, and an inking unit including an inking roller contacting the matrix strip on the printing roller.

Printers of the aforementioned type are generally known to feature a relief matrix in the form of a sheet of flexible polymer material, and may form part of high-speed printing plants, mainly for printing black and white publications. On book printing plants, the matrix strip is generally in the form of an endless strip wound on to the printing roller, containing all the matrixes relative to the pages in the book, and so varying in length accordingly.

For good quality printing, calendered or glazed paper of suitable substance must be employed; and known plants normally feature oil-based inking units comprising a series of rollers for grinding, mixing, spreading and transferring the ink on to the matrix strip.

Inking units of the aforementioned type present several drawbacks. To begin with, they are extremely cumbersome and complex as regards operation, due to the large number of rollers required for spreading the ink satisfactorily. The rollers are normally made of steel with a smooth outer surface to which the ink adheres mainly due to its viscosity, for spreading a thin film of ink on to the matrix strip.

As oil-based ink is absorbed very slowly by the above types of paper, a drier must be provided for drying the web as soon as it is printed, which drying process seriously dehydrates the paper, often to the extent of altering its physical characteristics and even its size, so that further provision must be made for rehydrating the web.

The high viscosity of oil-based ink also results in leftover ink accumulating to the side of the edge of the relief characters on the matrix, which leftover ink subsequently results in printed characters with a marked edge (edge effect) surrounding less heavily inked portions corresponding to the actual edge of the character, and by which the printed character is deformed and thickened.

Moreover, oil-based inking units do not permit multicolour printing, due to the difficulty in rapidly cleaning or changing all the rollers when switching from one color to another. Finally, oil-based inks also pose environmental problems, due to the nonbiodegradable and highly pollutant nature of the components involved, so that high-cost processes are required for disposing of leftover ink.

High-speed printers using water-based ink, e.g. for printing newspapers, have already been proposed. These, however, feature a flexographic matrix fitted to the printing roller and therefore of fixed length, so that they are unsuitable for printing books with a variable number of pages requiring a matrix strip of variable length.

What is more, printers of the above type normally employ low-cost paper of maximum 40 gr/sq.m substance, by which water-based ink is absorbed rapidly, thus resulting in printed characters with fairly uneven edges, and are therefore unsuitable for quality printing of calendered or glazed paper of a higher substance.

SUMMARY OF THE INVENTION

It is an object of the present invention to provide a straightforward, reliable printer of the aforementioned type, employing water-based ink and calendered or glazed paper, and designed to overcome the aforementioned drawbacks typically associated with known printers.

According to the present invention, there is provided a high-speed web printer with flexographic matrix means, comprising at least a printing roller supporting said matrix means; a pressure roller for pressing said web against said matrix means at a first portion of said printing roller; and an inking unit including an inking roller contacting said matrix means at a second portion of said printing roller; characterized by the fact that the cylindrical outer surface of said inking roller presents microincisions, and is partially immersed in water-based ink inside a tank; blade type doctoring means being provided for removing surplus ink from said surface prior to transferring the ink on to said matrix means.

BRIEF DESCRIPTION OF THE DRAWINGS

A preferred embodiment of the present invention will be described by way of example with reference to the accompanying drawings, in which:

FIG. 3 shows a partial, larger-scale section of the inking roller;

FIG. 4 shows a highly enlarged portion of the outer surface of the inking roller;

DETAILED DESCRIPTION OF THE INVENTION

Figure 1:
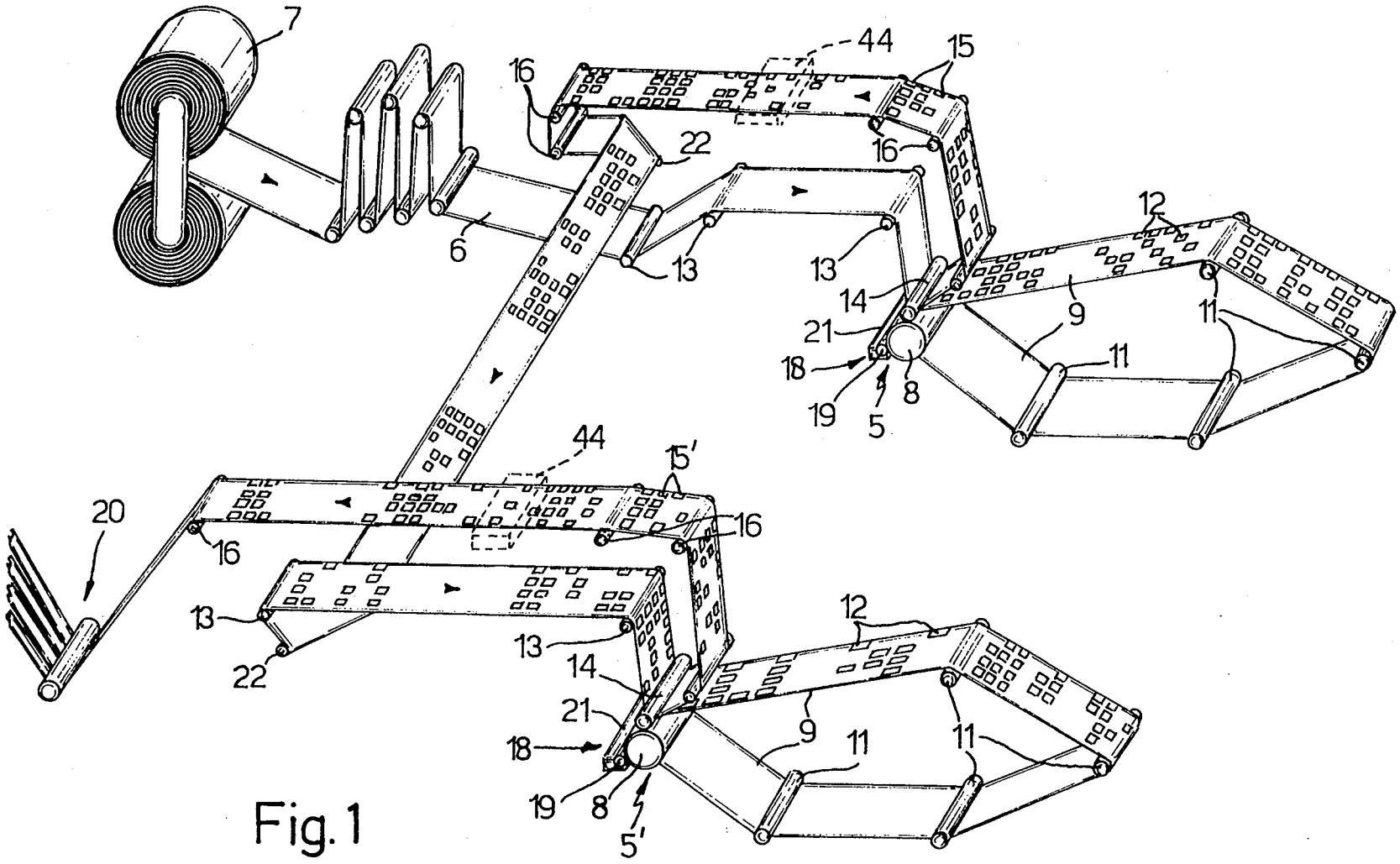
FIG. 1 shows a partial view of an integrated book printing and manufacturing system comprising a printer in accordance with the present invention.

Number 5 in FIG. 1 indicates a high-speed printer, particularly for publications requiring good quality print and paper, and for printing a web 6 wound off a reel 7.

Printer 5 comprises a printing roller 8 supporting a matrix strip 9 substantially consisting of an endless strip 9 of flexible polymer material, wound about printing roller 8 and about a series of guide rollers 11, at least one of which provides for tensioning. Roller 8 is rotated continuously so as to feed forward matrix strip 9, the outer surface of which presents a number of relief matrices 12 arranged in four columns and each corresponding to a page 15 of the publication for printing.

Web 6 is guided by a series of rollers 13, and is wound about a pressure roller 14 by which it is brought into contact with matrix strip 9 at a first facing portion of printing roller 8. Roller 14 is rotated continuously at the same surface speed as printing roller 8, and, downstream from roller 14, the printed web 6 is guided away from matrix strip 9 by a second series of guide rollers 16.

Printer 5 also comprises an inking unit 18 in turn comprising an inking roller 19 contacting matrix strip 9 at a second facing portion of printing roller 8, and which provides for transferring ink from a tank 21 on to the surface of strip 9.

Printer 5 forms part of an integrated book printing and manufacturing system, so that strip 9 presents the matrices 12 of one side of the sheets in the book, e.g. the sides corresponding to odd pages 15. For printing the other side of the sheets, provision is made for a second printer 5' identical to printer 5, and the strip 9 of which presents the matrices 12 corresponding to the other side of the sheets in the book, i.e. the even pages 15'.

The printed web 6 from printer 5 is turned over by means of two reversing rollers 22, and then fed between pressure roller 14 and printing roller 8 of printer 5' by means of a second series of guide rollers 13. After the second print run, web 6 is guided by a further series of rollers 16 to a sheet cutting station 20, and the sheets are collected automatically and fed to a series of known softbinding or paper binding stations.

Book printing requires quality paper of a substance ranging from 50 to 120 gr/sq.m. The paper may be calendered or glazed for ensuring relatively low absorption and so preventing the ink spreading and distorting the print.

Tank 21 (FIG. 2) of each inking unit 18 is supplied with water-based ink 23 comprising an acrylic pigment dissolved in water or in an aqueous solution in the amount of 15 to 25% of the solution. The solution is preferably slightly alkaline with a pH of 8 to 9.

Ink 23 must be quick-dry with a viscosity of 20 to 40 sec measured according to the so-called cup viscometer method, which consists in measuring the time, in seconds, taken for a predetermined amount of liquid in a cup to flow through a conduit of given size. As we know, water-based inks are considerably less viscous as compared with oil-based types, so that special steps must be taken for transferring and spreading ink 23 on to matrix strip 9.

Figure 2:
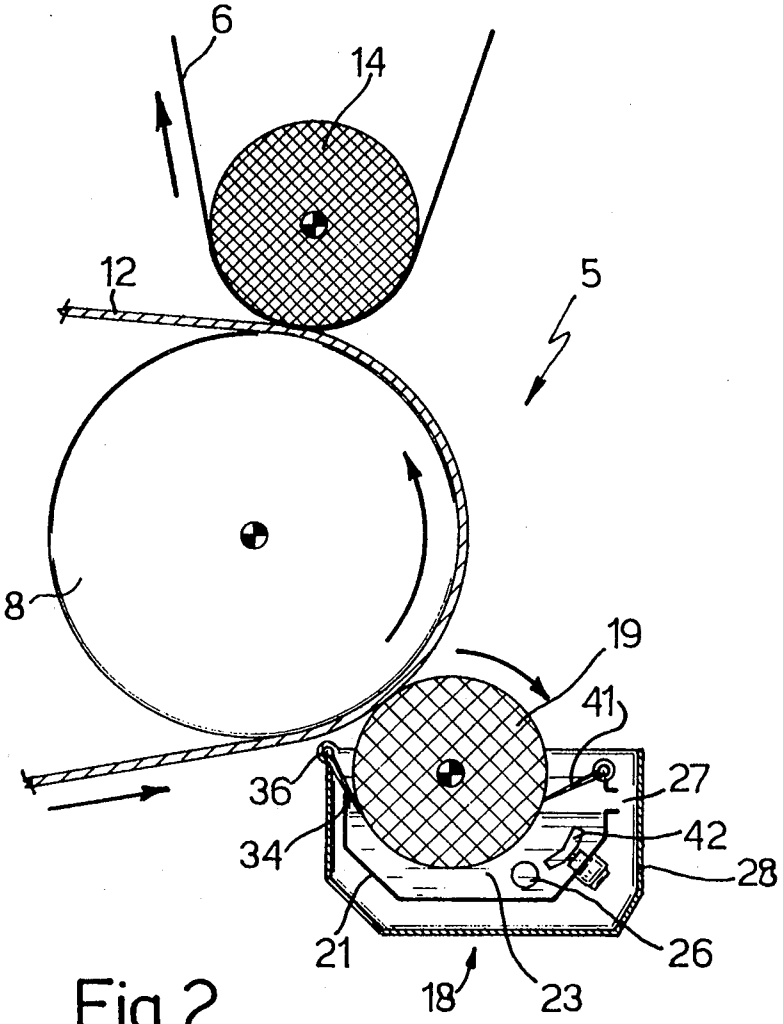
FIG. 2 shows a larger-scale schematic section of the inking unit on the printer, as viewed from the opposite side to that in FIG. 1.

According to the present invention, the cylindrical outer surface of inking roller 19 presents microincisions 24 (FIG. 3), and is partially immersed in ink 23 in tank 21 (FIG. 2). For this purpose, tank 21 presents an ink supply conduit 26 and an overflow drain 27, so that ink 23 is maintained at a constant level, and any surplus ink flows into a container 28.

More specifically, inking roller 19 presents a cylindrical support 29 (FIG. 3) made of steel and covered with a 0.5 to 2 mm thick layer of copper 31 in which microincisions 24 are formed in any known manner, and which in turn is covered with a wearproofing 7–8 μm thick layer of chromium 32.

Microincisions 24 consist of microdepressions defined by undulating microribs 33 (FIG. 4) perpendicular to the generating line of the cylindrical surface of roller 19. The adjacent microribs 33 are symmetrical, so that microincisions 24 vary in width along the perpendicular to the generating line.

More specifically, excellent results have been obtained in printing tests using microdepressions 24 with a depth "h" (FIG. 3) of 15 to 25 μm, and defined by microribs 33 with, axially on the surface of roller 19, a minimum distance "d" of a few μm, and a maximum distance D of 75 to 95 μm.

Inking unit 18 (FIG. 2) also comprises a doctor blade 34 pivoting about an axis 36 parallel to the axis of roller 19. Doctor blade 34 is made of steel, and is pushed elastically so that its free edge engages the surface of roller 19 at a point between tank 21 and the point of contact with matrix strip 9, and so removes any surplus ink from the surface of roller 19 prior to transfer on to matrix strip 9.

The ink 23 transported by microincisions 24 constitutes a calibrated reserve sufficient for inking the matrix. Said ink 23, in fact, on contacting the raised parts of the matrix, adheres to the surface of the raised parts and is immediately transferred on to web 6 at the point of contact at pressure roller 14. As water-based ink is fast-drying, no drier is required along the path of web 6 defined by rollers 16.

Printing tests using inking unit 18 as described above have afforded excellent results as compared with traditional oil-based inking units. Even after numerous print runs, the characters so printed remain clear, with a sharp edge and constant thickness.

Using the same paper, on the other hand, and a traditional oil-based inking unit, the printed web 6 must be dried, and the character invariably presents a ragged edge and, as printing continues, the so-called edge effect. This consists in a marked edge, outwards of the ragged edge, which considerably increases the thickness of the printed character and, as we know, is caused by ink particles accumulating, due to its viscosity, to the side of the raised part of the character on matrix strip 9.

Figure 5:
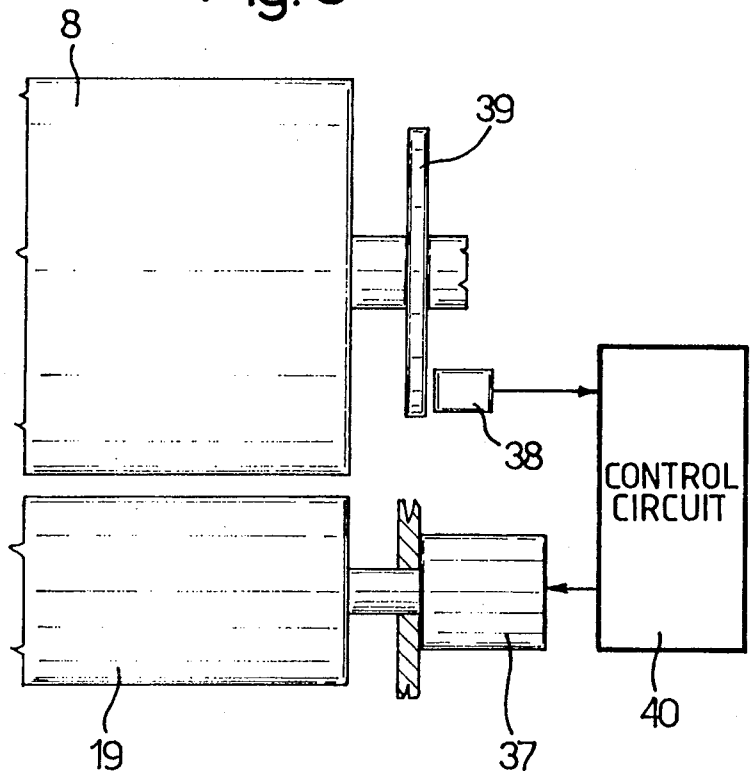
FIG. 5 shows the inking roller control device.

Inking roller 19 must be so rotated as to result in no slippage on matrix strip 9, for which purpose, roller 19 is rotated by a servomotor 37 (FIG. 5) controlled, via a known control circuit 40, by a speed transducer 38 for detecting the speed of printing roller 8. Transducer 38 may advantageously consist of the sensor of an impulse wheel 39 integral with roller 8.

Transducer 38 may also be used for controlling a further servomotor (not shown) for rotating pressure roller 14 (FIG. 2), so that forward feed of web 6 is also timed perfectly with printing roller 8.

By virtue of the fast-drying characteristic of water-based ink 23 and perfectly timed rotation of rollers 8, 14 and 19, printing speed may also be increased considerably. In fact, excellent results have been obtained with web feed speeds of up to 5 m/sec.

Inking unit 18 also comprises a doctor 41 of Teflon (registered trade mark) for protecting ink 23 in tank 21, which houses a continuously rotating fan 42 for preventing ink 23 from settling inside the tank.

Tank 21 may also be provided with a viscosity sensor (not shown) for monitoring the viscosity of the ink during printing; and a temperature sensor (not shown) for controlling heat exchangers inside an ink tank supplying tank 21.

Figure 6:
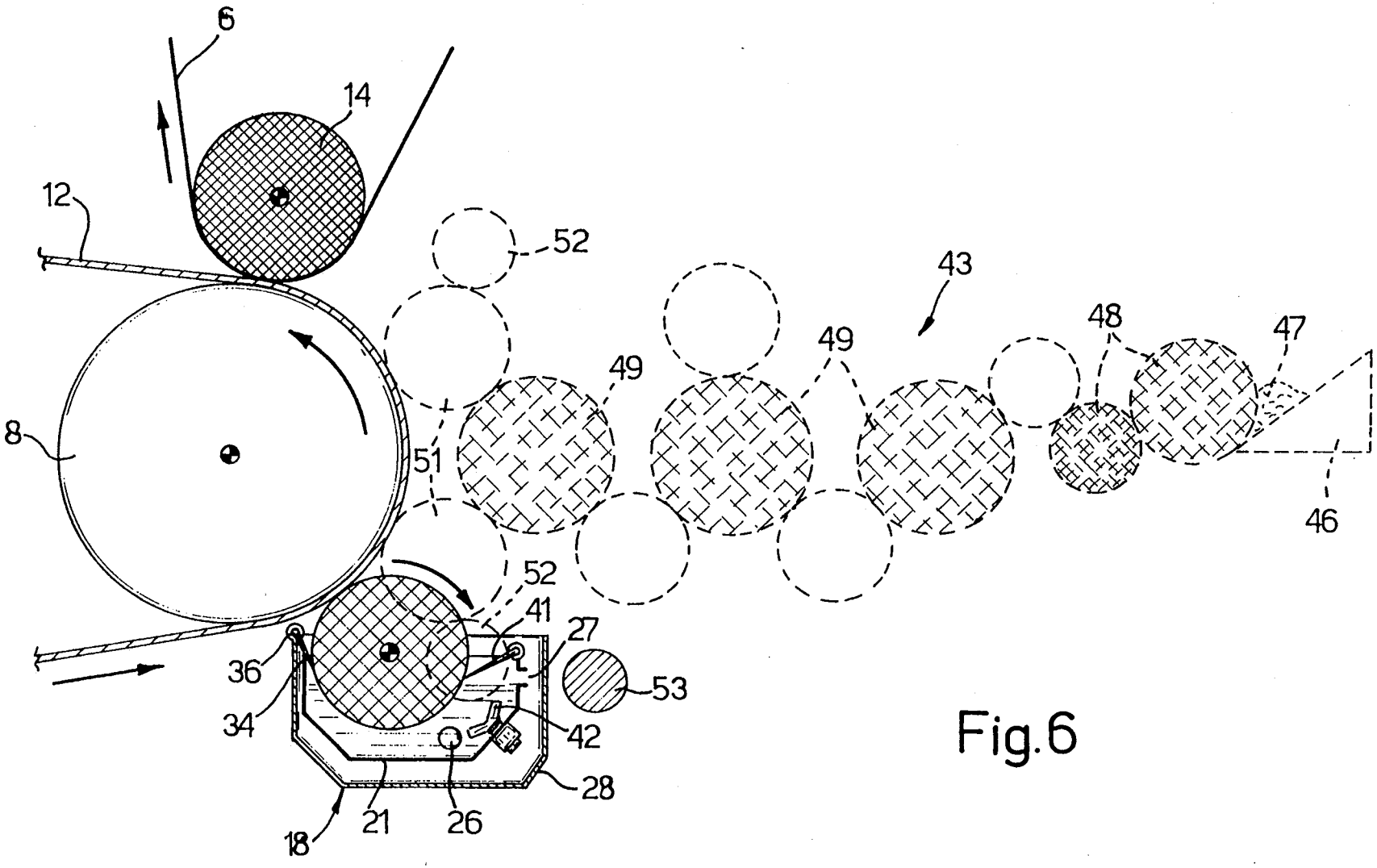
FIG. 6 shows a section, similar to that of FIG. 2, of a variation of the printer.

In the FIG. 6 variation, inking unit 18 is fitted to printer 5, 5' in easily removable manner, for enabling alternative use of a standard oil-based inking unit 43 (shown by the dotted line in FIG. 6), in which case, printer 5, 5' must be provided with a standard drier 44 (shown by the dotted line in FIG. 1) for unit 43.

Unit 43 comprises a feedbox 46 (FIG.6) for oil-based ink 47; a set of ink grinding rollers 48; a series of rollers 49 with respective counter-rollers, for mixing, transferring and spreading the ink evenly; and two inking rollers 51 with respective counter-rollers 52, and contacting matrix strip 9. Rollers 48–52 are all operated synchronously by a drive shaft and via gearing (not shown).

The two pairs of rollers 51, 52 are fitted in easily removable manner, for enabling assembly of water-based inking unit 18, which thus substitutes for unit 43. In the FIG. 6 variation, printer 5, 5' also comprises control means (not shown) for deactivating drier 44 when inking unit 18 is assembled.

The advantages of the printer according to the present invention will be clear from the foregoing description. In particular, water-based inking unit 18 is far more straightforward and economical as compared with oil-based inking unit 43, in addition to enabling drier 44 to be dispensed with or disconnected.

A further major advantage is that, being soluble in water, any waste ink requires no processing, and is therefore non-pollutant. Water-based ink 23 also provides for rapid cleaning of matrix strip 9, for switching easily from one colour ink to another and so enabling multicolour surface printing. Finally, inking unit 18 provides for improved character definition, and for considerably increasing printing speed.

To those skilled in the art it will be clear that changes and improvements may be made to printer 5, 5' as described and illustrated herein without, however, departing from the scope of the present invention. For example, changes may be made to the size of roller 19 or the design of microincisions 24; and means may be provided for moistening matrix strip 9 prior to contact with roller 19.

In addition to pigment, ink 23 may also contain dyes, or comprise, in the water solution, other liquids and additives, such as acrylic polymers, organic alkalizing agents or glycols, for appropriately adjusting its chemical and physical characteristics. Finally, strip 9 may be fixed directly to roller 8, and/or printer 5, 5' may be used for printing other than books.

We claim:

1. A high-speed web printer for web printing with flexographic matrix means, comprising at least a printing roller supporting said matrix means:

a pressure roller for pressing said web against said matrix means at a first portion of said printing roller; and an inking unit including an inking roller contacting said matrix means at a second portion of said printing roller;

wherein the cylindrical outer surface of said inking roller presents microincisions, and is partially immersed in water-based ink inside a tank;

blade type doctoring means being provided for removing surplus ink from said surface prior to transferring the ink on to said matrix means; and wherein said inking roller includes a cylindrical support made of steel and covered with a 0.5 to 2 mm thick layer of copper in which said microincisions are formed, said microincisions consisting of microdepressions of a depth of about 15 to 25 μm, and defined by symmetrical, undulated microribs.

2. A printer as claimed in claim 1, wherein axially, said microribs present a minimum distance of a few μm, and a maximum distance of 75 to 95 μm.

3. A printer as claimed in claim 1, wherein rotation of said inking roller is controlled by a servomotor in turn controlled by a speed transducer for detecting the speed of said printing roller.

4. A printer as claimed in claim 3, wherein it forms part of an integrated book printing and manufacturing system;

forward feed of said web also being controlled by said transducer.

5. A high-speed printer for web printing with flexographic matrix means for an integrated book printing and manufacturing system, comprising:

at least a printing roller supporting said matrix means;

a pressure roller for pressing said web against said matrix means at a first portion of said printing roller; and an inking unit including an inking roller contacting said matrix means at a second portion of said printing roller;

wherein the cylindrical surface of said inking roller presents microincisions, and is partially immersed in water-based ink inside a tank;

blade-type doctoring means being provided for removing surplus ink from said surface prior to transferring the ink on to sad matrix means;

wherein the rotation of said inking roller is controlled by a servomotor in turn controlled by a speed transducer for detecting the speed of said printing roller, said transducer also controlling the forward speed of said web, wherein said matrix means may also by inked alternatively by a second oil-based inking unit, drying means being provided for drying the printed web;

wherein said first inking unit and at least part of said second inking unit are removable and fittable alternatively in the operating position; and control means being provided for excluding said drying means when said first inking unit is assembled.

6. A high-speed printer for web printing with a flexographic matrix means, said printer comprising:

a printing roller supporting said matrix means;

a pressure roller for pressing said web against said matrix means at a first portion of said printing roller;

a water-based inking unit including a tank carrying a water-based ink; and an inking roller partially immersed in said ink and contacting said matrix means at a second portion of said printing roller, said inking roller having a cylindrical support made of steel, said support being covered with a layer of copper provided with microincisions, and wherein said microincisions are formed of microdepressions defined by symmetrical, undulated microribs substantially perpendicular to the generating line of said inking roller, so that the width of said microdepressions varies along the perpendicular to the generating line.

7. A printer as claimed in claim 6, wherein said matrix means comprise a matrix strip with a series of matrices corresponding to pages of a book;

said web being calendered or glazed paper with a substance of 50 to 120 gr/sq.m;

said ink being fast-drying and presenting a viscosity of 25 to 35 seconds as measured using the cup viscometer method; and means being provided for advancing said web at the same speed as said matrix strip.

8. A printer as claimed in claim 7, wherein said ink comprises at least an acrylic pigment dissolved in water or in an aqueous solution in the amount of 15 to 25% of the solution;

said solution presenting a pH of 8 to 9.

9. A printer as claimed in claim 6, wherein said matrix means may also be inked alternatively by an oil-based inking unit, drying means being provided for drying the printing web and wherein said water-based inking unit and at least part of said oil-based inking unit are removable and fitted alternatively in the operative position; and control means being provided for excluding said drying means when said water-based inking unit is assembled.

* * * * *